US005213329A

United States Patent [19]

Okumoto et al.

[11] Patent Number: 5,213,329

[45] Date of Patent: May 25, 1993

[54] GOLF CLUB HEAD

[75] Inventors: Takaharu Okumoto, Chigasaki; Tetsuo Hayashi; Atsushi Onozato, both of Hiratsuka, all of Japan

[73] Assignee: The Yokohama Rubber Co., Ltd., Tokyo, Japan

[21] Appl. No.: 760,905

[22] Filed: Sep. 17, 1991

[30] Foreign Application Priority Data

Sep. 25, 1990 [JP] Japan ..... 2-99006[U]

[51] Int. Cl.[5] ..... A63B 53/04

[52] U.S. Cl. ..... 273/172; 273/174; 273/167 A

[58] Field of Search ..... 273/167-175, 273/164.1, 77 R, 77 A, 193 R, 194 R, 183 D

[56] References Cited

U.S. PATENT DOCUMENTS

| | | | |
|---|---|---|---|
| 1,531,821 | 3/1925 | Scott | 273/164 X |
| 1,669,482 | 5/1928 | Miller | 273/174 |
| 1,913,821 | 6/1933 | Stumpf | 273/174 X |
| 2,255,332 | 9/1941 | Russell | 273/174 |
| 3,680,868 | 8/1972 | Jacob | 273/167 A |
| 3,761,095 | 9/1973 | Thompson | 273/172 X |
| 3,815,921 | 6/1974 | Turner | 273/167 A X |
| 4,332,388 | 6/1982 | Crow | 273/172 |
| 4,804,184 | 2/1989 | Maltby | 273/172 X |

FOREIGN PATENT DOCUMENTS

| | | | |
|---|---|---|---|
| 54-115929 | 9/1979 | Japan . | |
| 55-40582 | 3/1980 | Japan . | |
| 57-34253 | 2/1982 | Japan . | |
| 62-108967 | 7/1987 | Japan . | |
| 364845 | 1/1932 | United Kingdom | 273/174 |

*Primary Examiner*—V. Millin
*Assistant Examiner*—Sebastiano Passaniti
*Attorney, Agent, or Firm*—Finnegan, Henderson, Farabow, Garrett & Dunner

[57] ABSTRACT

A golf club head having a main body made of synthetic resin as a main material and a sole plate of metal material molded integrally with the club head main body. The sole plate has an its bottom surface at least one projection formed independently of the sole plate and fixed thereto so that it extends in a back and forth direction relative to the direction of swing of the club.

9 Claims, 2 Drawing Sheets

GOLF CLUB HEAD

BACKGROUND OF THE INVENTION

The present invention relates to a golf club head. More particularly, it relates to an improvement to a golf club head which is provided with a projection extending in the back and forth or swing direction of the club on the bottom surface of the club's sole so as to make a smooth followthrough at the time of duffing.

In regard to a wood-type golf club head, in particular, it sometimes happens that the speed of the head lowers or the motion path of the head is disordered, when the player duffs at hitting. In order to improve the follow-through of the golf club head at the time of this duffing, golf club heads having a projection extending in the back and forth, direction and provided on the surface of the sole integral therewith have been proposed heretofore in the Japanese patent application Kokai publication Nos. 54-115929 and 55-40582, Japanese utility model application Kokai publication Nos. 57-34253, 62-108967, etc.

In the prior-art golf club heads disclosed in these publications however, the, sole and the projection are molded integrally with each other, and therefore the projection becomes a hindrance when the surface of the sole is ground, thus making the grinding operation also difficult. When the golf club head is constructed of a golf club main body made of synthetic resin as a main material and of a sole plate made of a metal material, which are molded integrally, in particular, grinding of the sole plate becomes even more difficult and this causes of lowering in productivity. Since the sole plate and the projection are molded monolithically of the same material, adjustment of the weight of the golf club head and adjustment of the center of gravity thereof are difficult, and this construction has prevented a reduction in the weight of the golf club head.

SUMMARY OF THE INVENTION

An object of the present invention is to provide a golf club head comprising a club head main body of synthetic resin as a main material and a sole plate of a metal material which are molded integrally, wherein grinding of the sole plate is facilitated, with a projection provided on the surface of the sole.

Another object of the present invention is to provide a golf club head not having an adverse effect on the adjustment of the weight of the golf club head and the adjustment of the center of gravity thereof, with a projection provided on the surface of the sole.

In order to attain the above-stated objects, according to the present invention, at least one projection is formed, independently of the sole plate and is fixed on the bottom surface of said sole plate so that it extends in the back and forth direction, in a golf club head comprising a club head main body of synthetic resin as a main material and a sole plate of a metal material which are molded integrally.

Since the projection is a separate piece independent of the sole plate the sole plate can be ground independently before the projection is fitted thereto and thus the grinding operation is facilitated. Moreover, since the projection is formed of another member unrestricted selection of the material thereof is possible. For example, materials of lighter weight not affecting the adjustment of the weight of the main body of the club head and the adjustment of the center of gravity thereof can be used. Furthermore, it is possible to select a material excellent in an abrasion resistance, an impact resistance strength and having a low friction coefficient, in addition to being lighter in weight.

DETAILED DESCRIPTION OF THE PREFERRED EMBODIMENTS

Figure 1:
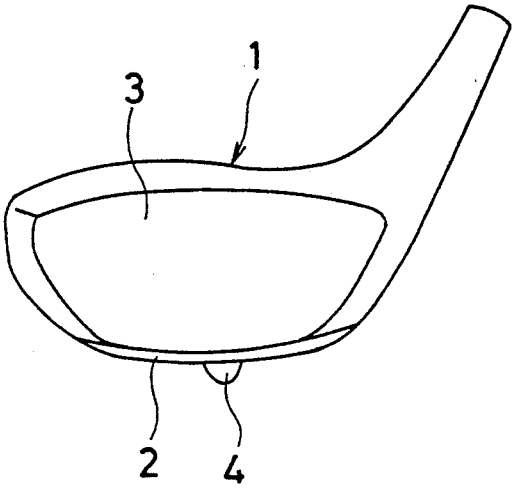
FIG. 1 is a front view of a golf club head according to an embodiment of the present invention.
Figure 2:
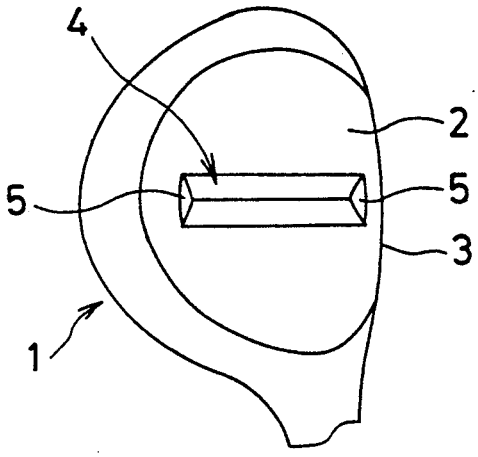
FIG. 2 is a bottom view of the golf club head of FIG. 1.
Figure 6:
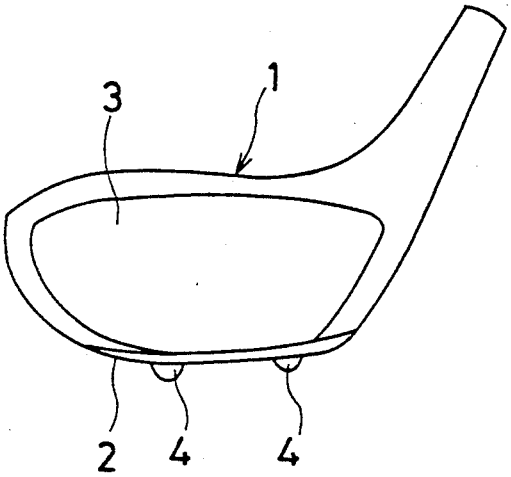
FIG. 6 is a front view of a golf club head according to another embodiment of the present invention.
Figure 7:
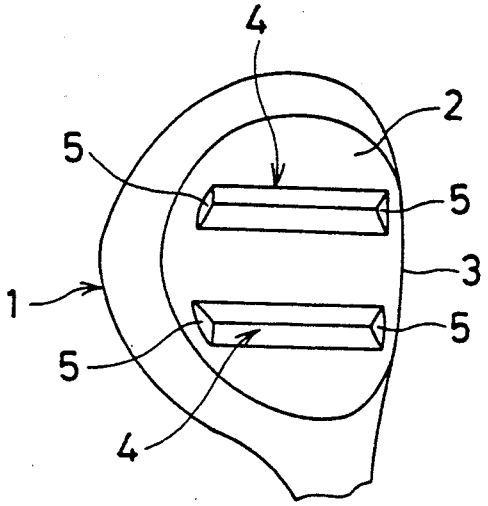
FIG. 7 is a bottom view of the golf club head of FIG. 6.
Figure 8:
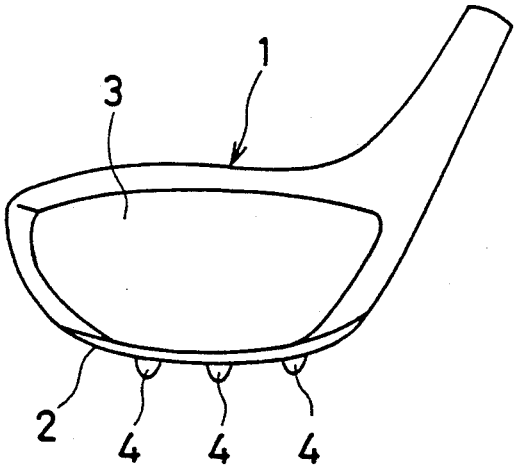
FIG. 8 is a front view of a golf club head according to still another embodiment of the present invention.

FIGS. 1 and 2 show a golf club head of a wood type according to the present invention, which is constructed of a club head main body 1 and a sole plate 2 which are molded integrally. The club head main body 1 has a ball-hitting face 3 in the front, while the sole plate 2 is provided with one projection 4 extending in the back and forth or swing direction on the lower or bottom side thereof. The number of this projection 4 is arbitrary, and it may be two as in the embodiment shown in FIGS. 6 and 7, three as in the embodiment shown in FIG. 8 or more than three as the occasion demands.

Figure 3:
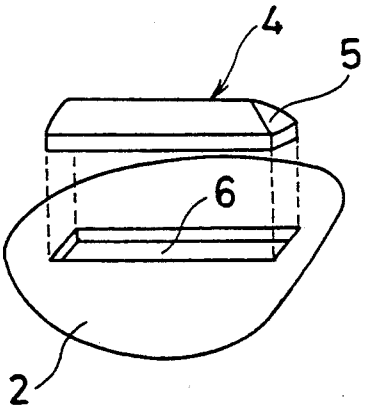
FIG. 3 is a perspective view illustrating a method of fixing a projection in the golf club head of the present invention.

The projection 4 is a separate member independent of the sole plate 2, and it is fitted into a groove 6 provided in the plate 2 so as to extend in the back and forth direction on the bottom surface thereto as shown in FIG. 3. Further it is secured in place by a suitable bonding agent to be fixed therein. The upper part of the projection 4 which protrudes from the surface of the sole plate 2 has a crosssection shaped substantially in the form of a triangle and also has a slanting surface 5 formed at least at the front end. Such a design for the projection 4 with a triangular cross section and a slanting surface 5 formed at the front end make for a smooth follow-through at the time of duffing. While this slanting surface 5 needs only to be provided on the front end side of the projection 4 at least, it may be provided also on the rear end side as shown in FIG. 2.

To fix the projection 4 to the sole plate 2, a bonding agent is not necessarily needed, and it can be fixed by screws as well. The bonding agent and the screws may also be used together. This projection 4 can be designed as to be removable as required, so that it can be replaced easily by another member when it is worn out, and thereby the lifetime of the golf club head can be prolonged.

Figure 4:
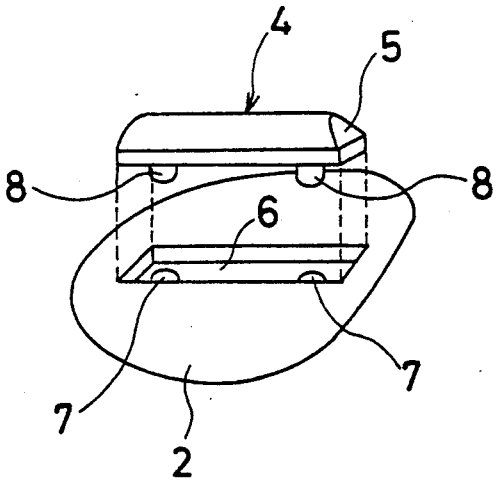
FIG. 4 is a perspective view illustrating a method of fixing a different projection.
Figure 5:
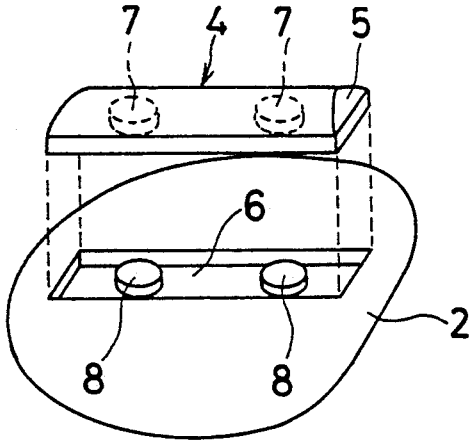
FIG. 5 is a perspective view illustrating a method of fixing still a different projection.

In the above-mentioned groove 6 an arbitrary number of holes 7 may be provided in the bottom of the groove so that protrusions 8 provided on the side of the projection 4 to be fitted therein can be inserted into in these holes 7 as in the example shown in FIG. 4. With the fitting of the protrusions 8 in the holes 7 the fixation of the projection 4 in the sole plate 2 is made stronger. As for the placing of these holes 7 and protrusions 8, the holes 7 may be provided on the projection 4 and the protrusions 8 in the groove 6 as in the example shown in FIG. 5, contrary to those in the example of FIG. 4.

All the golf club heads of the present invention described above have a structure wherein the club head main body made of synthetic resin as a main material and the sole plate of a metal material are molded integrally. As for the synthetic resin used for the club head main body, fiber reinforced plastics are used preferably. The sole plate is formed of a metal material, and an aluminum alloy, a copper alloy, a titanium alloy, stainless steel or the like is used preferably as the metal material.

As for the method of fixing the projection to the sole plate, it is preferable to adopt a structure, as in the above-described embodiments, wherein a groove is provided on the bottom of the sole plate side and the lower part of the projection is fitted into this groove. It is desirable that, after the projection is fitted into the groove of the sole plate in this way, fixation thereof is secured further by a bonding agent or screws or by using the bonding agent and the screws together.

As for the material of the projection, a material of lighter weight is preferable and, moreover, a material excellent in abrasion resistance, an impact strength and having a low friction coefficient in addition to being light-weight is preferable. As for a material having these functions, a fiber reinforced metal of a light metal or an engineering plastic, for instance, can be used. As a fiber reinforced metal of a light metal, either of aluminum or an aluminum alloy reinforced with whiskers or carbon fibers can be used. Also, either or an aluminum and the aluminum alloy reinforced with ceramic powder can be used as the material of the projection. As for an engineering plastic, nylon, polyester, poly-etherketone and polyphenylene sulfide can be used.

While the present invention described above is effective, in particular, when applied to a wood-type golf club head, it is also applicable to an iron-type golf club head.

Since the projection is constituted of another member and is independent of the sole plate, according to the present invention described above, it is possible to grind the sole plate independently before the projection is fitted thereto. Accordingly, the operation of grinding the sole plate is more efficient since it is not hindered by the projection, in contrast to the cases of prior-art golf club heads, and consequently production can be improved. Since the projection is a separate member independent of the sole plate, it is possible to select a different material for it and preferably one light in weight and excellent in abrasion resistance, and impact strength and having a low friction coefficient. Adjustment of the weight of the golf club head and the adjustment of center of gravity thereof thus can be more readily accomplished.

What is claimed is:

1. A golf club head comprising a club head main body made of a synthetic resin material and a sole plate made of a metal material molded integrally therewith, said sole plate having a front end and a back end relative to the direction of swing of the golf club head and a bottom surface, at least one elongated groove in the bottom surface of the sole plate extending in said swing direction between said front and back ends, said groove having a width and a length, and at least one separate, elongated projection member independent of said sole plate securable in said groove so as to extend in said swing direction, said projection member having a width and length similar to that of said groove and a substantially uniform thickness such that an upper part of said projection member extends outwardly beyond said bottom surface of said sole plate, the cross section of said upper part of said projection member being shaped substantially in the form of a triangle end having a slanted surface on an end thereof adjacent to the front end of said sole plate and facing said direction of swing.

2. The golf club head of claim 1, wherein said projection member is formed of a fiber reinforced metal that is lighter than the metal material of the sole plate.

3. The golf club head of claim 2, wherein said fiber reinforced metal is either aluminum or an aluminum alloy reinforced with whiskers.

4. The golf club head of claim 2, wherein said fiber reinforced metal is either aluminum or an aluminum alloy reinforced with carbon fibers.

5. The golf club head of claim 1, wherein said projection member is formed of either aluminum or an aluminum alloy reinforced with ceramic powder.

6. The golf club head of claim 1, wherein said projection member is formed of a plastic material.

7. The golf club head of claim 1, wherein the metal material of said sole plate is of a metal selected from the group consisting of an aluminum alloy, a copper alloy, a titanium alloy and stainless steel.

8. The golf club head of claim 1, including a plurality of separate projection members secured in a plurality of corresponding grooves in the bottom surface of the sole plate.

9. The golf club head of claim 1, wherein said golf club head is a wood-type golf club head.

* * * * *

UNITED STATES PATENT AND TRADEMARK OFFICE

CERTIFICATE OF CORRECTION

PATENT NO. : 5,213,329

DATED : May 25, 1993

INVENTOR(S) : Takaharu Okumoto et al.

It is certified that error appears in the above-identified patent and that said Letters Patent is hereby corrected as shown below:

Claim 1, column 4, line 25, change "end" to --and--.

Signed and Sealed this

First Day of February, 1994

Bruce Lehman

*Attest:*

BRUCE LEHMAN

*Attesting Officer*

*Commissioner of Patents and Trademarks*